US009587810B2

(12) United States Patent
Parekh

(10) Patent No.: US 9,587,810 B2
(45) Date of Patent: Mar. 7, 2017

(54) APPARATUSES AND METHODS FOR INSTALLING LIGHT MODULES

(71) Applicant: Esmail Khalid Parekh, Diamond Bar, CA (US)

(72) Inventor: Esmail Khalid Parekh, Diamond Bar, CA (US)

( * ) Notice: Subject to any disclaimer, the term of this patent is extended or adjusted under 35 U.S.C. 154(b) by 21 days.

(21) Appl. No.: 14/268,920

(22) Filed: May 2, 2014

(65) Prior Publication Data

US 2015/0109804 A1 Apr. 23, 2015

Related U.S. Application Data

(60) Provisional application No. 61/893,620, filed on Oct. 21, 2013.

(51) Int. Cl.

| | |
|---|---|
| ***F21V 21/00*** | (2006.01) |
| ***F21V 21/096*** | (2006.01) |
| ***F21V 19/00*** | (2006.01) |
| *F21Y 101/00* | (2016.01) |

(52) U.S. Cl.

CPC ..... *F21V 21/096* (2013.01); *F21S 4/28* (2016.01); *F21V 19/004* (2013.01); *F21Y 2101/00* (2013.01); *F21Y 2103/30* (2016.08); *F21Y 2105/10* (2016.08); *F21Y 2115/10* (2016.08); *Y10T 29/4913* (2015.01)

(58) Field of Classification Search

CPC .. F21V 21/096; F21V 19/004; Y10T 29/4913; F21S 4/28; F21Y 2101/00; F21Y 2105/10; F21Y 2115/10; F21Y 2103/30

USPC ..... 362/398

See application file for complete search history.

(56) References Cited

U.S. PATENT DOCUMENTS

2011/0176297 A1* 7/2011 Hsia ..... F21V 25/04 362/217.1

* cited by examiner

*Primary Examiner* — Anh Mai
*Assistant Examiner* — Hana Featherly
(74) *Attorney, Agent, or Firm* — Dorsey & Whitney LLP

(57) ABSTRACT

Apparatuses and methods for installing light modules are described. One such apparatus includes a light emitting diode (LED) module including one or more LEDs, a printed circuit board (PCB), and a connector. The apparatus further includes a holder for retaining the LED module and a magnet attached to the lower surface of the holder. The apparatus may then be attached to a surface by the magnet.

21 Claims, 9 Drawing Sheets

APPARATUSES AND METHODS FOR INSTALLING LIGHT MODULES

CROSS-REFERENCE

This application claims the benefit of the earlier filing date of U.S. Provisional Application No. 61/893,620 filed Oct. 21, 2013, which application is incorporated herein by reference, in its entirety, for any purpose.

BACKGROUND

Light emitting diodes (LEDs) are an increasingly popular choice due to their long life and lower power requirements than traditional incandescent bulbs. LEDs are used for new light fixtures in both commercial and domestic environments. Easier installation and flexibility to move light fixtures to new locations may be advantageous. Additionally, it may be desirable to be able to retrofit existing incandescent-fixtures with LEDs.

Installing a light fixture often involves making holes in a surface and installing fasteners in the holes to retain the light fixture. Retrofitting an existing light fixture may also involve making holes in the existing fixture and using fasteners to install a new LED module. Making holes and installing fasteners may be difficult due to the material of the surface and/or take a significant amount of time. Once the fixture is installed, it is often difficult to relocate the fixture to a new location. Relocating may involve drilling additional holes, and repairing the holes in the surface at the old location.

DETAILED DESCRIPTION

The present application describes apparatuses and methods for installing light modules. Many specific details of certain embodiments of the disclosure are set forth in the following description and the figures provide a thorough understanding of such embodiments. One skilled in the art, however, will understand that the present embodiments of the disclosure may be practiced without several of the details and components described in the following description.

Figure 1:
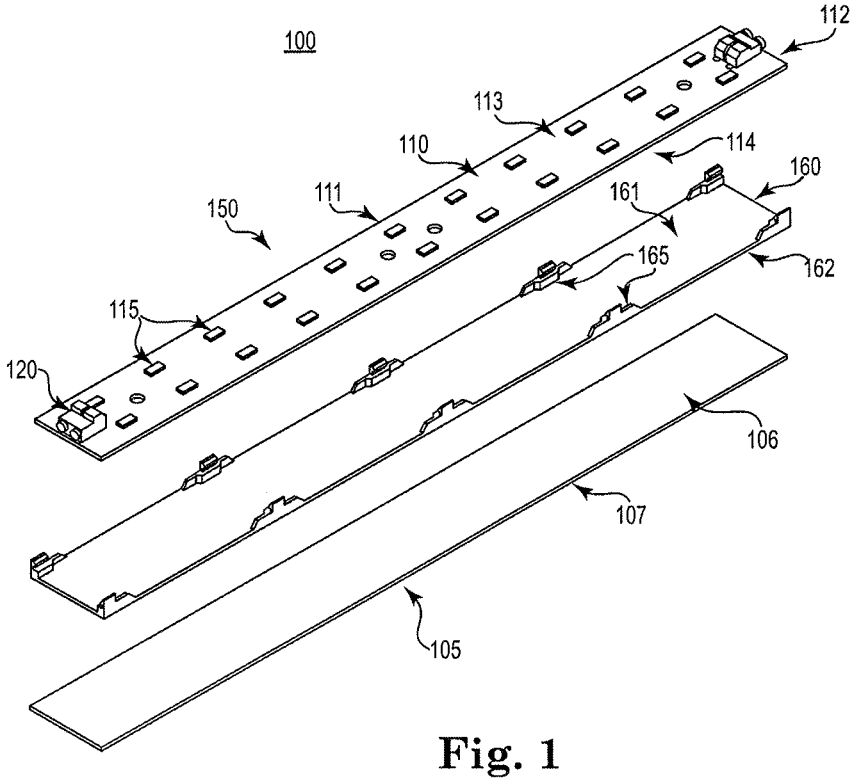
FIG. 1 is an exploded view of a light module according to an example embodiment of the invention.
Figure 2:
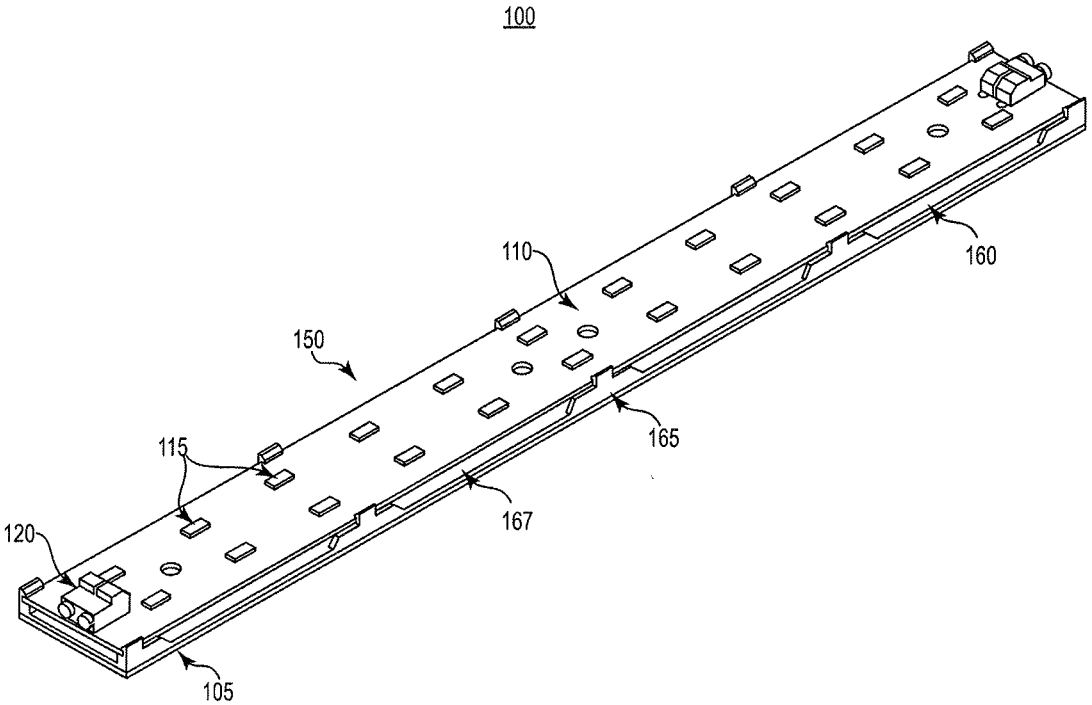
FIG. 2 is a view of the embodiment illustrated in FIG. 1

A light module 100 in accordance with an embodiment of the invention is illustrated in FIG. 1. The light module 100 has a generally rectangular shape. The light module 100 includes a light emitting diode (LED) module 150, a holder 160, and a magnet 105. The LED module 150 may include a printed circuit board (PCB) 110. The PCB 110 may be aluminum, plastic, or other material. The PCB 110 may include conductive traces (not shown in FIG. 1). The LED module may further include one or more LEDs 115 on an upper surface 113 of the PCB 110 and one or more connectors 120 attached to the PCB 110. The connectors 120 may be placed at one or more edges of the PCB 110. In the example shown in FIG. 1, the connectors 120 are placed along a narrow end 112 of the PCB 110. The LEDs 115 and the connectors 120 may be coupled to the conductive traces of the PCB 110. The connectors 120 may allow the LEDs 115 to be coupled to an LED driver and/or power source (not shown). The connectors 120 may also allow two or more LED modules 150 to be coupled to each other. Any suitable electrical connector known in the art may be used. The LED module 150 may be retained in the holder 160. The holder 160 may be made of plastic, metal, or other material. The holder 160 may include one or more clips 165 that may engage the LED module 150. In some embodiments, the clips 165 may engage the LED module 150 along a perimeter of the LED module 150. The clips 165 may include a shoulder or other feature that retains the LED module 150 and provides a gap 167 (not shown in FIG. 1) between a lower surface 114 of the PCB 110 and an upper surface 161 of the holder 160. The gap 167 may be seen in FIG. 2, which illustrates the LED module 150 retained in the holder 160. The gap 167 may allow air to flow between the LED module 150 and the holder 160. The clips 165 may be configured to retain the LED module 150 without the LED module 150 contacting the upper surface 161 of the holder 160.

Referring back to FIG. 1, the holder 160 may have a magnet 105 attached to a lower surface 162 of the holder 160. In some embodiments, the magnet is attached to the lower surface 162 of the holder 160 by an adhesive. The adhesive may be applied to an upper surface 106 of the magnet 105 or the lower surface 162 of the holder 160. A lower surface 107 of the magnet may remain exposed. In some embodiments, the magnet 105 and/or holder 160 may have an adhesive applied to a surface and a protective cover (not shown) placed over the adhesive. An example of a material that may be used for the magnet 105 with adhesive is 3M™ Flexible Magnet Tape. The protective cover may be removed from the magnet 105, and the holder 160 attached to the magnet 105 prior to or at the time of installation. The magnet 105 may alternatively be attached to the holder 160 by a fastener, for example, screws, rivets, or other fasteners known in the art.

In some embodiments, the dimensions of the holder 160 may be greater than or less than the dimensions of the long end 111 and/or the short end 112 of the PCB 110. When the dimensions of the holder 160 are greater than the PCB 110, the holder may optionally retain additional LED modules 150. When the dimensions of the holder 160 are less than the dimensions of the PCB 110, a portion of LED module 150 may extend beyond the upper surface 161 of the holder 160. In the latter example, the LED module 150 may still be retained by the holder 160.

The light module 100 may be installed by placing it on a metal surface. The surface may be a wall, an existing light fixture, or other surface. The surface may also be of another material that has magnetic properties. The magnet 105 retains the light module 100 to the surface. The connector 120 may be coupled to an LED driver and/or power source (not shown). No drilling of holes or installation of fasteners is required. The LED driver and/or power source may also be attached to the surface by a magnet. In some embodiments, the LED driver and/or power source may be included in the LED module 150.

Figure 3A:
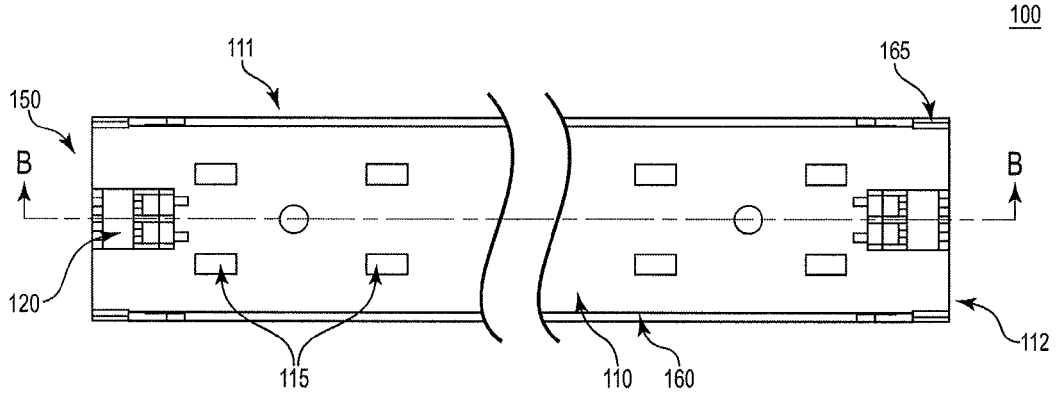
FIG. 3A is a top view of the embodiment illustrated in FIG. 1.
Figure 3B:
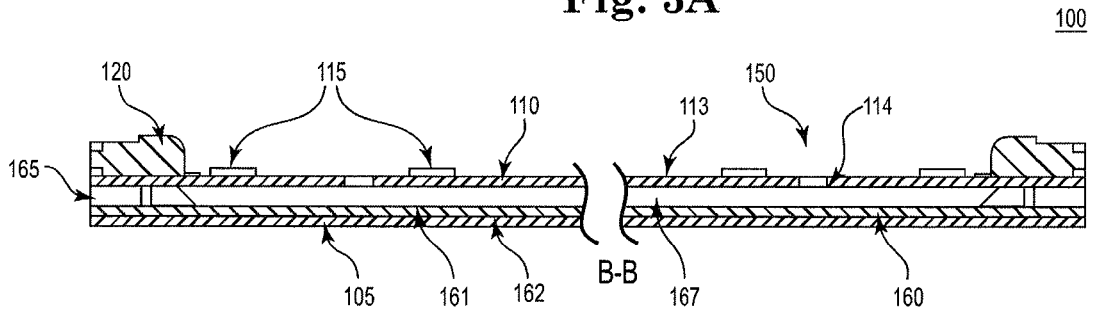
FIG. 3B is a side view of the embodiment illustrated in FIG. 1.

FIG. 3A is a top view of the light module 100. In this embodiment, the magnet 105 does not extend beyond the edges of the holder 160. In other embodiments, the dimensions of the magnet 105 may be greater than or less than the dimensions of the bottom surface of the holder 160. In other embodiments, there may be a plurality of magnets 105 attached to the holder 160 at, locations on the bottom surface of the holder 160. FIG. 3B is a side view of the light module 100 along the line defined by B-B as seen in FIG. 3A. The magnet 105 is shown attached to the bottom surface of the holder 160, and the gap 167 between the LED module 150 and the upper surface of the holder 160 may be observed.

Figure 4:
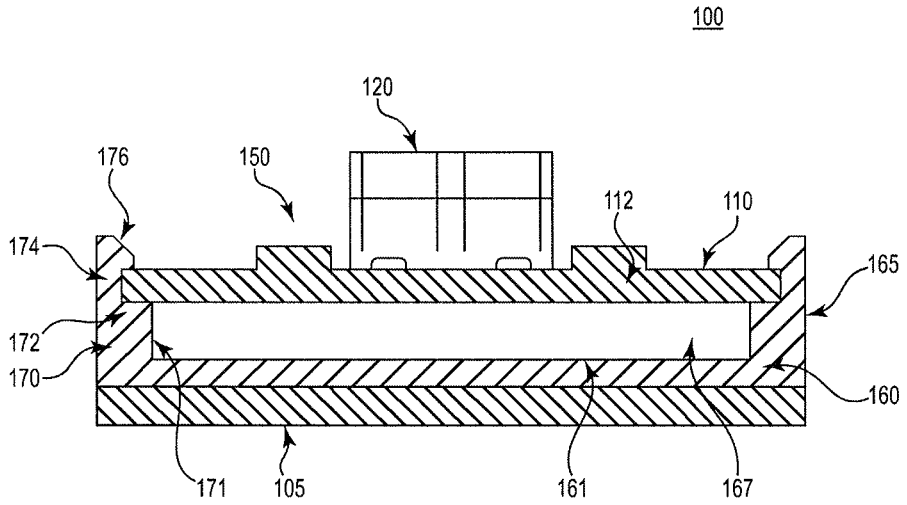
FIG. 4 is a side view of the narrow end of the embodiment illustrated in FIG. 1.

FIG. 4 illustrates a side view of the narrow end 112 of the PCB 110 in the light module 100. In this example, the connectors 120 are at the edge of the narrow end 112 such that multiple light modules 100 may be coupled at the narrow ends to make an elongated fixture, for example, a strip. In another embodiment, the connectors 120 are along; a long edge 111 of the PCB 110. In such an embodiment, the light modules may be coupled along the long edges to make a wider fixture, for example, a wider rectangle.

Still referring to FIG. 4, a side view of an example embodiment of the clip 165 may be observed. The clip 165 may be made as an integral portion of the holder 160 or may be a separate component attached to the holder 160. The clip 165 may be made of a resilient material such that the clip 165 may be temporarily deformed to insert the LED module 150 into the holder 160. The clip 165 may then return to its normal position to retain the LED module 150. In other embodiments, the clip 165 is a rigid material and the LED module 150 is slid into the clip to be retained by the clip 165. The clip 165 may include an elongated member 170 that extends from the upper surface 161 of the holder 160. The elongated member 170 may have a notch 174 formed from an inner portion 171 to define a shoulder 172 that holds the LED module 150 a distance away from the upper surface of the holder 160 to form gap 167. The notch 174 may also define an upper lip 176 that may retain the LED module 150 against the shoulder 172. In some embodiments, the elongated member 170 may include additional adjacent portions coupled between the elongated member 170 and the holder 160 (not shown in FIG. 4). These adjacent portions may provide additional reinforcement and/or stability to the clip 167.

Figure 5:
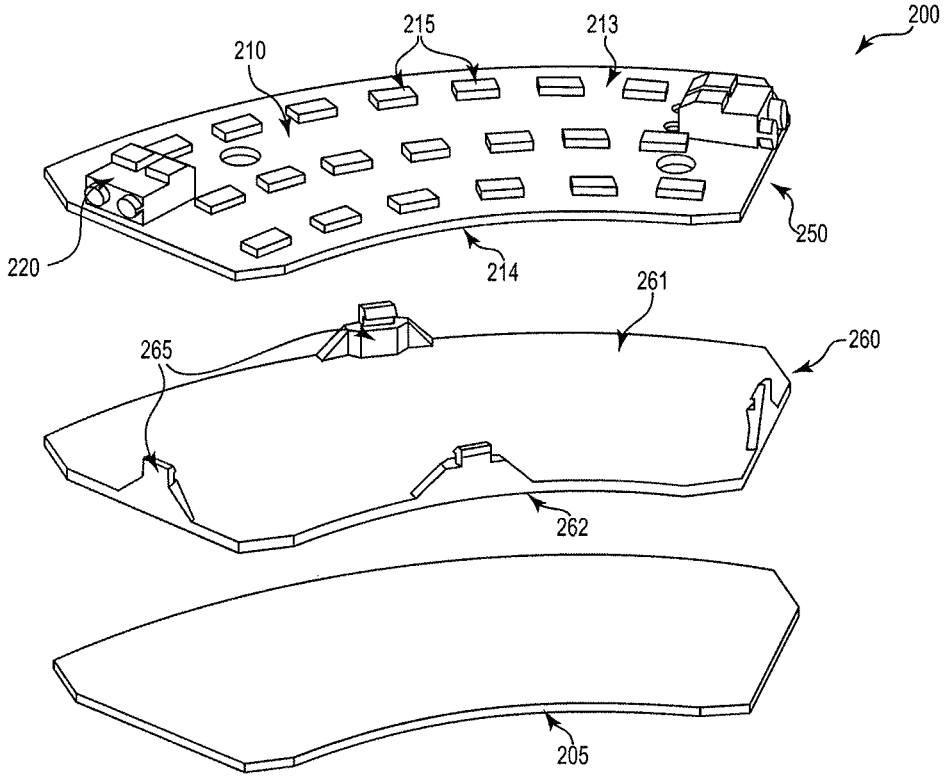
FIG. 5 is an exploded view of a light module according to an example embodiment of the invention.

FIG. 5 illustrates an exploded view of another embodiment of the invention. In this embodiment, the light module 200 has a generally curved shape. The light module 200 may include an LED module 250, holder 260, and a magnet 205. The LED module 250 may include one or more LEDs 215 and one or more connectors 220 on a PCB 210, similar to light module 100. The PCB 210 may include conductive traces (not shown in FIG. 2). The LEDs 215 and the connectors 220 may be coupled by the conductive traces of the PCB 210. The magnet 205 may be attached to a lower surface 262 of holder 260 in a similar manner as the magnet 105 is attached to holder 160. The holder 260 may include one or more clips 265 that may retain the LED module 250 to the holder 260 while maintaining a gap 267 (not shown in FIG. 5), between an upper surface 261 of the holder 260 and a lower surface 214 of the LED module 250. The gap 267 can be seen in FIG. 6, which illustrates the assembled light module 200. The structure and retention mechanism of the clips 265 may be similar to the clips 165 of light module 100. Although embodiments of the light module have been illustrated as having specific shapes illustrated in the figures, other embodiments of a light module may be made having other desired shapes without departing from the scope of the present invention.

Figure 6:
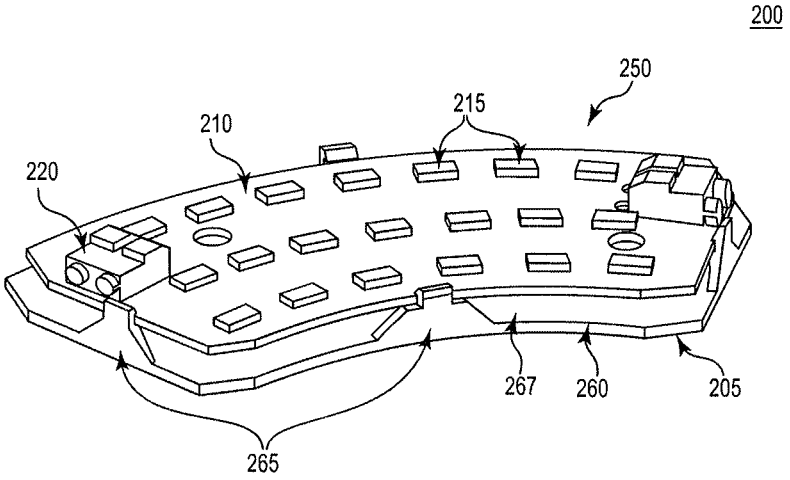
FIG. 6 is a view of the embodiment illustrated in FIG. 5.

FIG. 6 is an assembled view of the light module 200. In this example embodiment, the connector 220 is placed on a surface of the PCB 210. The connector 220 may be coupled to an LED driver and/or power source. Power may be provided to the LEDs 215 from the connector 220 through the conductive traces of the PCB 210. The connectors 220 may also be used to couple multiple light modules 200 together to form a ring or other desired structure.

Figure 7A:
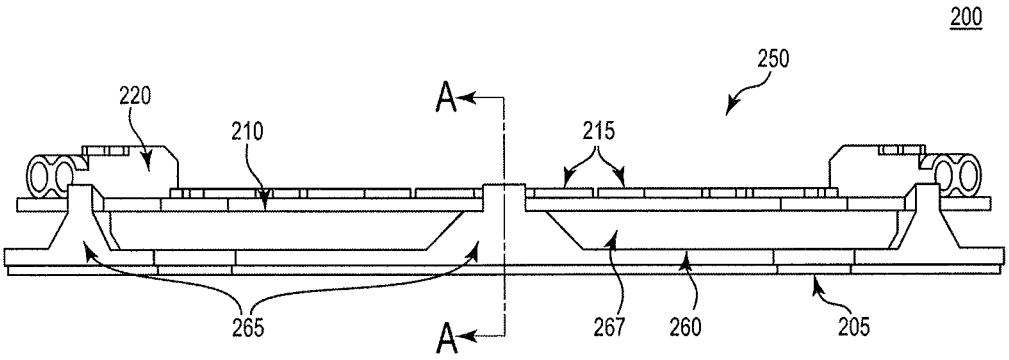
FIG. 7A is a side view of the embodiment illustrated in FIG. 5.
Figure 7B:
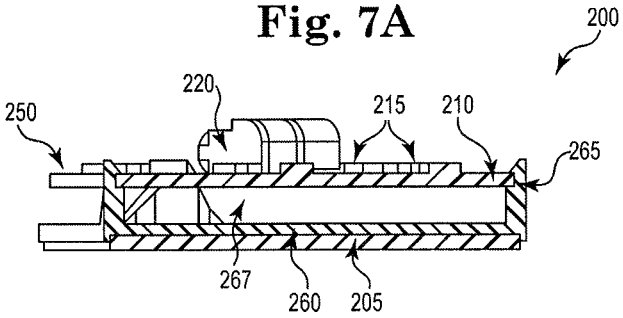
FIG. 7B is a side view of the narrow end of the embodiment illustrated in FIG. 5.

FIG. 7A is a side view of the light module 200 with the magnet 205 attached to the holder 260. The light module 200 may be installed on a surface in a similar manner to the light module 100. FIG. 7B is a side view of the light module 200 along the narrower dimension of the PCB 210 at a cut defined by line A-A in FIG. 7A. The shoulder structure of the dips 265 and the gap 267 between the LED module 250 and the upper surface of the holder 260 can be observed.

A light module according to an embodiment of the invention may come as a kit that includes the light module, an LED driver, and a power source or power adapter. The power source may be a battery, a solar panel, or other suitable power source. The power source may be configured to be coupled to the LED driver to provide power. The power adapter may be configured to provide power from a conventional and/or pre-existing power source. For example, the power adapter may be configured to be coupled to a standard incandescent bulb socket, fluorescent light spring socket, or other pre-existing power source known in the art. The power adapter may be further configured to also couple to the LED driver or directly to the light module.

Figure 8:
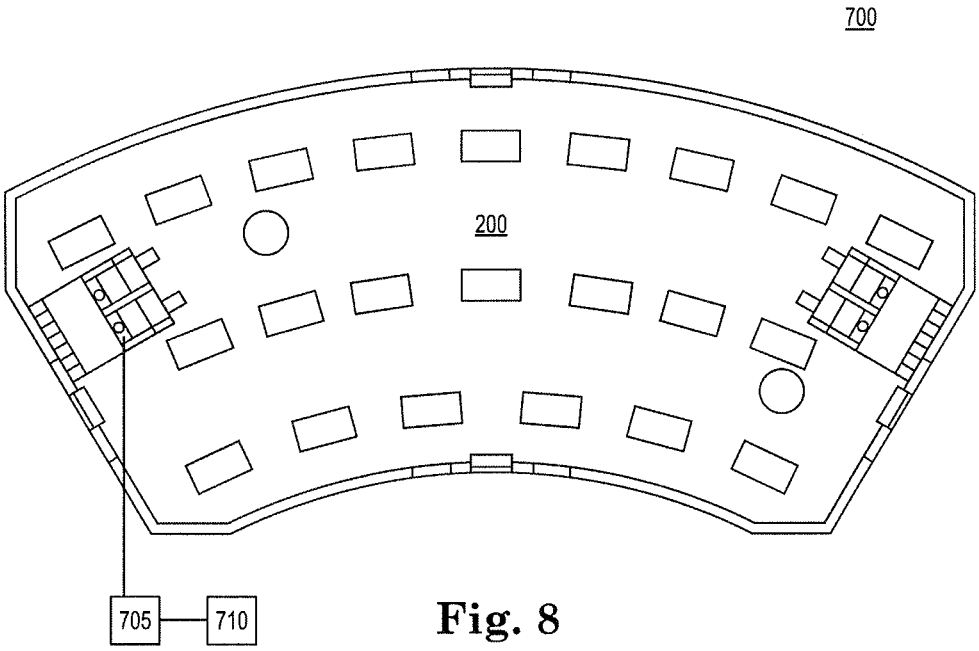
FIG. 8 is an illustration of a kit according to an embodiment of the invention.

FIG. 8 illustrates an example embodiment of a kit 700. The light module 200 may be coupled to an LED driver 705, which is coupled to a power source 710. Both the LED driver 705 and the power source 710 may also have magnets for attachment to a metal surface (not shown). The magnets may be attached directly to the LED driver 705 and/or power source 710 or the LED driver 705 and/or power source 710 may be retained in holders (not shown) similar to the holder 260. To install, the light module 200, LED driver 705, and power source 710 may all be placed on a wall or other surface and retained by the magnets. The LED driver 705 may then be coupled to the light module 200 and the power source 710. Connector wires or other electrical coupling method may be used to couple the light module 200 to the LED driver 705 and/or the power source 710.

Figure 9:
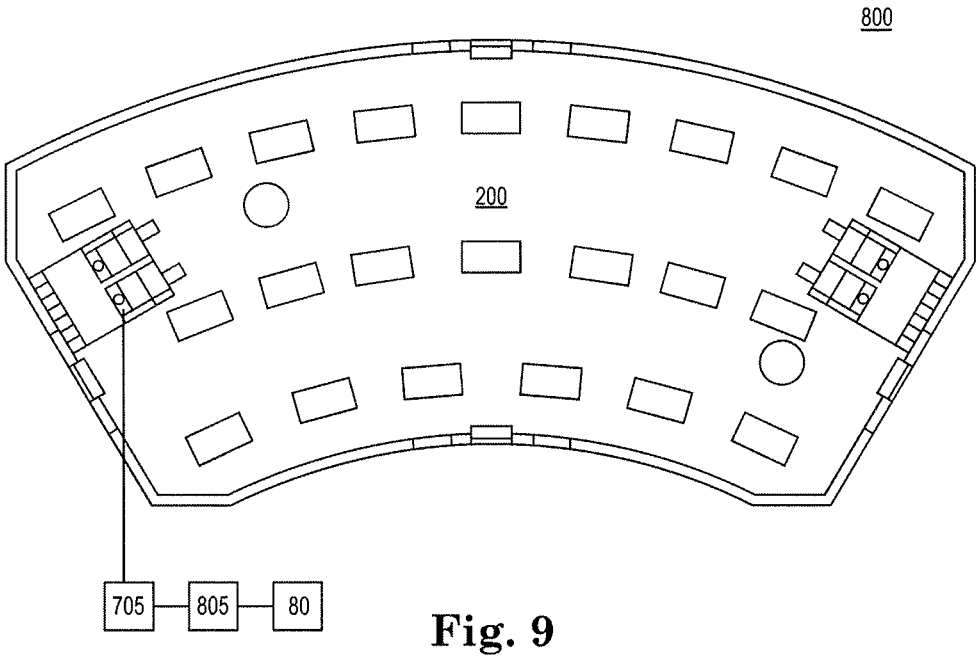
FIG. 9 is an illustration of a kit according to another embodiment of the invention.

FIG. 9 illustrates another example embodiment of a kit 800. The light module 200 may be coupled to an LED driver 705, which is coupled to a power adapter 805. The power adapter may further be coupled to an existing power source 80 as described previously. Both the LED driver 705 and the power adapter 805 may also have magnets for attachment to a metal surface (not shown). The power adapter 805 may not have a magnet attached in some embodiments. It may alternatively be retained by the existing power source 80. For example, the existing power source 80 may have a socket in which the power adapter 805 is configured to be retained. To install, the light module 200, LED driver 705 may be placed on a wall or other surface and retained by magnets. The power adapter 805 may also be retained by magnets or may be coupled directly to the existing power source 80. The power adapter 805 may be coupled to the existing power source 80 and further coupled to the LED driver 705 to provide power. The LED driver 705 is further coupled to the light module 200.

It will be appreciated that while the kits illustrated in FIGS. 8 and 9 include the light module 200 having a generally curved shape, other configurations of light modules according to an embodiment of the present invention (e.g., light module 100) may be included in the kit instead of or in addition to the light module 200.

The apparatuses and methods described above may be used to install new light modules or to retrofit existing light fixtures with LED light modules. The apparatuses and methods disclosed may reduce or eliminate the need to make holes in a surface or install fasteners. The time required for installation or retrofitting of light fixtures may be reduced. The light modules may also be more easily removed and/or relocated to different locations. From the foregoing it will be appreciated that, although specific embodiments of the invention have been described herein for the purposes of illustration, various modifications may be made without deviating from the spirit and scope of the invention.

What is claimed is:

1. An apparatus, comprising:

an LED module comprising one or more LEDs on an upper surface of the LED module, the LED module further comprising a lower surface opposite the upper surface;

a holder comprising an upper surface and a lower surface opposite the upper surface, the holder configured to be attached to the LED module to position the upper surface of the holder below the lower surface of the LED module, wherein the holder is configured to retain the LED module with a gap between the lower surface of the LED module and the upper surface of the holder; and a magnet attached to the lower surface of the holder for attaching the apparatus to a magnetic surface.

2. The apparatus of claim 1 wherein the holder includes a clip to retain the LED module at a perimeter of the LED module.

3. The apparatus of claim 2 wherein the clip includes an elongated member extending vertically from the upper surface of the holder, wherein the elongated member includes a notch in an inner surface of the elongated member and wherein the notch at least partially defines a shoulder and an upper lip for retaining the LED module.

4. The apparatus of claim 1 wherein the LED module comprises a printed circuit board, an LED coupled to the printed circuit board, and a connector coupled to the printed circuit board.

5. The apparatus of claim 4 wherein the holder is metal.

6. The apparatus of claim 1 wherein the LED module is rectangular.

7. The apparatus of claim 1 wherein the LED module is curved.

8. The apparatus of claim 1 wherein the magnet has the same dimensions as the lower surface of the holder.

9. The apparatus of claim 1 wherein the magnet has smaller dimensions than the lower surface of the holder.

10. The apparatus of claim 9 wherein a second magnet is attached to the lower surface of the holder.

11. The apparatus of claim 1, further comprising a second LED module coupled to the LED module.

12. The apparatus of claim 1 wherein the holder is plastic.

13. An apparatus, comprising:

an LED module comprising one or more LEDs on an upper surface of the LED module, the LED module further comprising a lower surface opposite the upper surface;

a holder comprising an upper surface and a lower surface opposite the upper surface, wherein the holder is configured to be attached to the LED module to position the upper surface of the holder below the lower surface of the LED module, and wherein the holder is configured to retain the LED module with a gap between the lower surface of the LED module and the upper surface of the holder;

a first magnet attached to the lower surface of the holder;

an LED driver configured to be coupled to the LED module; and a second magnet attached to a lower surface of the LED driver.

14. The apparatus of claim 13, further comprising a power source configured to be coupled to the LED driver.

15. The apparatus of claim 14, further comprising a third magnet attached to a lower surface of the power source.

16. The apparatus of claim 13, further comprising a power adapter configured to couple to the LED driver and further configured to couple to a power source.

17. The apparatus of claim 16, further comprising a fourth magnet coupled to a lower surface of the power adapter.

18. A method, comprising:

coupling an LED module to a holder, wherein the LED module comprises an upper surface, a lower surface opposite the upper surface, and one or more LEDs on the upper surface, wherein the holder comprises an upper surface and a lower surface opposite the upper surface, and wherein coupling the LED module to the holder comprises positioning the upper surface of the holder below the lower surface of the LED module;

coupling the holder to a surface with a first magnet attached to the lower surface of the holder;

coupling an LED driver to the surface with a second magnet attached to the LED driver;

coupling the LED driver to the LED module; and coupling the LED driver to a power source.

19. The method of claim 18, further comprising coupling the power source to the surface with a third magnet.

20. The method of claim 18, further comprising coupling a power adapter to the power source, and the LED driver is coupled to the power adapter.

21. The method of claim 20, further comprising coupling the power adapter to the surface with a fourth magnet.

* * * * *